US010500466B2

(12) United States Patent
Kim

(10) Patent No.: US 10,500,466 B2
(45) Date of Patent: Dec. 10, 2019

(54) TRAINING DEVICE AND MODULAR TRAINING APPARATUS SYSTEM WITH THE TRAINING DEVICE HAVING JOINT FUNCTION

(71) Applicant: TYRENN CO., LTD., Daejeon (KR)

(72) Inventor: Sug Whan Kim, Gimpo-si (KR)

(73) Assignee: TYRENN CO., LTD., Daejeon (KR)

( * ) Notice: Subject to any disclaimer, the term of this patent is extended or adjusted under 35 U.S.C. 154(b) by 19 days.

(21) Appl. No.: 15/718,301

(22) Filed: Sep. 28, 2017

(65) Prior Publication Data

US 2018/0093154 A1 Apr. 5, 2018

Related U.S. Application Data

(60) Provisional application No. 62/403,730, filed on Oct. 4, 2016.

(51) Int. Cl.
*A63B 69/34* (2006.01)
*A63B 69/00* (2006.01)

(52) U.S. Cl.
CPC ..... *A63B 69/34* (2013.01); *A63B 69/004* (2013.01); *A63B 2209/00* (2013.01);
(Continued)

(58) Field of Classification Search
CPC ..... A63B 1/00; A63B 1/005; A63B 15/00; A63B 21/00058; A63B 21/00069; A63B 21/00072; A63B 21/00076; A63B 21/00178; A63B 21/00181; A63B 21/00185; A63B 21/002; A63B 21/0023; A63B 21/02; A63B 21/0021; A63B 21/023; A63B 21/027; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/0615; A63B 21/0616; A63B 21/0617; A63B 21/068; A63B 21/08; A63B 21/15;
(Continued)

(56) References Cited

U.S. PATENT DOCUMENTS 2,909,371 A * 10/1959 Alcover ..... A63B 23/00 482/148
4,519,608 A * 5/1985 Gilly ..... A63B 69/38 473/215

(Continued)

FOREIGN PATENT DOCUMENTS

JP 3054652 12/1998
JP 3181634 2/2013

(Continued)

*Primary Examiner* — Gary D Urbiel Goldner
(74) *Attorney, Agent, or Firm* — Lex IP Meister, PLLC

(57) ABSTRACT

A training device has a joint function suitable for training various complex motions for various body parts such as an arm, a leg, a head, and a trunk for training martial arts. The training device includes: a shaft; a joint having a diameter larger than that of the shaft and disposed at one end portion of the shaft; a joint support contacting the joint and elastically supporting the joint; and a shaft support elastically supporting an outer side of the shaft at the one end portion of the shaft.

10 Claims, 21 Drawing Sheets

(52) U.S. Cl.
CPC ..... *A63B 2209/08* (2013.01); *A63B 2210/00* (2013.01); *A63B 2225/09* (2013.01)

(58) Field of Classification Search
CPC ... A63B 21/159; A63B 21/16; A63B 21/4027; A63B 21/4041; A63B 21/4045; A63B 21/4047; A63B 21/4049; A63B 69/004; A63B 69/20; A63B 69/201; A63B 69/203; A63B 69/205; A63B 69/206; A63B 69/208; A63B 69/24; A63B 69/26; A63B 69/32; A63B 69/325; A63B 69/34; A63B 69/345; A63B 2069/0042; A63B 2069/0044; A63B 71/0036; A63B 71/0054; A63B 2071/0063; A63B 2071/0072; A63B 2071/0081; A63B 2071/009; A63B 2210/00; A63B 2210/50; A63B 2225/09; A63B 2225/093
USPC ..... 482/83–90
See application file for complete search history.

(56) References Cited

U.S. PATENT DOCUMENTS

| | | | | |
|---|---|---|---|---|
| 7,309,303 | B1 * | 12/2007 | Proctor | A63B 3/00 482/121 |
| 7,559,881 | B1 * | 7/2009 | Roraff | A63B 21/023 482/126 |
| 2014/0274585 | A1 * | 9/2014 | Huang | A63B 23/10 482/79 |
| 2016/0296782 | A1 * | 10/2016 | Dai | A63B 5/11 |
| 2017/0074316 | A1 * | 3/2017 | Kim | B25J 17/0275 |
| 2017/0292562 | A1 * | 10/2017 | Kim | F16D 3/22 |
| 2017/0367864 | A1 * | 12/2017 | Kim | A61F 5/01 |

FOREIGN PATENT DOCUMENTS

| | | |
|---|---|---|
| KR | 10-2006-0040442 | 5/2006 |
| KR | 10-2011-0028690 | 3/2011 |
| WO | 2012-083214 | 6/2012 |

* cited by examiner

TRAINING DEVICE AND MODULAR TRAINING APPARATUS SYSTEM WITH THE TRAINING DEVICE HAVING JOINT FUNCTION

TECHNICAL FIELD

The present invention relates to a training device having a joint function and a modulator training apparatus system with the training device, and more particularly, to a training device suitable for training various complex operations for various body parts including arms, legs, a head, and a trunk for exercise of martial arts and a modular training apparatus system which has the training device to obtain various training operations and training effects and is easily disassembled and assembled.

BACKGROUND ART

When practicing martial arts such as boxing, taekwondo, hapkido, and judo, trainees train through competition with one another or train with equipment such as sandbags designed for individual training.

Generally, the sandbag is installed on a ceiling of a room, and the sandbag is designed to be used while standing on a floor like the sandbag disclosed in Korean Patent Unexamined Publication No. 2006-0040442.

When using the sandbag in the related art, since the sandbag has only a portion corresponding to a trunk of a person, the sandbag is suitable for the trainee to train only an operation of hitting the trunk with a hand or the leg or pushing the trunk with a shoulder. That is, the sandbag in the related art is not suitable for training complex operations such as hitting, grasping and pulling, bending, pushing a part corresponding to the arm or leg of the person.

Korean Patent Unexamined Publication No. 2011-0028690 discloses a judo training device. The judo training device mimics a structure and a motion of the arm or leg of the person using wires, rollers, electromagnets, and complex link assemblies to provide a function to train a judo technique. However, cost of installation increases because there are too many components that constitute the judo training device. In addition, using a judo training device having such a structure, it is possible to train only the operation of hitting or pulling the arm or leg but it is difficult to train a variety of complex motions such as the motion of bending or pushing the arm or leg.

PRIOR ART DOCUMENT

Patent Document (Patent Document 1) Korean Patent Unexamined Publication No. 2006-0040442 (May 10, 2006)

(Patent Document 2) Korean Patent Unexamined Publication No. 2011-0028690 (Mar. 22, 2011)

DISCLOSURE

Technical Problem

The present invention has been made in an effort to provide a training device having a joint function capable of effectively exercising various complex motions on various body parts such as an arm, a leg, a trunk, and a head in order to practice martial arts. The present invention has also been made in an effort to provide a modular training apparatus system which has a training device having a joint function capable of training various motions and is easily disassembled and assembled.

Technical Solution

An exemplary embodiment of the present invention provides a training device including: a shaft; a joint having a diameter larger than that of one end portion of the shaft and disposed at one end portion of the shaft; a joint support contacting the joint and elastically supporting the joint; and a shaft support elastically supporting an outer side of the shaft at the one end portion of the shaft.

The joint may have a cross section having a circular, oval, or a polygonal shape and a 3D shape including an outer surface which is convex or concave and the joint support may have a joint contact portion having a concave or convex shape corresponding to a part of the outer surface of the joint and having elasticity.

The shaft support may include a first contact portion elastically supporting the outer side of the one end portion of the shaft and a second contact portion disposed spaced apart from the first contact portion toward an opposite side to the one end portion to elastically support the outer side of the shaft.

When the shaft and the joint are pulled in a direction away from the joint support, the first contact portion may be widened and the joint may thus move between the first contact portion and the second contact portion, and the shaft may be supported by the second contact portion.

The training device may further include a case supporting the first and second contact portions and surrounding the one end portion of the shaft.

Each of the first and second contact portions may include a mounting portion supported by the case and an elastic portion which extends toward the outer side of the shaft from the mounting portion to elastically support the outer side of the shaft.

The elastic portions of the first and second contact portions may face each other and extend toward the outer side of the shaft from the mounting portion.

The mounting portion of the first contact portion may be disposed at a location corresponding to the one end portion of the shaft in the case, the elastic portion of the first contact portion may extend in a direction opposite to the one end portion of the shaft, the mounting portion of the second contact portion may be disposed at a location spaced apart from the mounting portion of the first contact portion in a direction toward the other end portion of the shaft in the case, and the elastic portion of the second contact portion may extend toward the one end portion of the shaft by crossing the elastic portion of the first contact portion.

The case may include a front case accommodating the first and second contact portions and a rear case accommodating the joint support.

Each of the first and second contact portions may include a shaft slider slidably installed in the case to be movable toward the outer side of the shaft and a shaft elastic support elastically supporting the shaft slider with respect to the case.

Each of the first and second contact portions may further include an elastic portion coupled to an end of the shaft slider to elastically contact the outer side of the shaft.

The joint may have a cross section having a circular, oval, or a polygonal shape and a 3D shape including an outer surface which is convex or concave and the joint support may have a joint slider slidably installed in the case in contact with the joint and a joint elastic support elastically supporting the joint slider with respect to the case.

At least a part of a portion which extends from the one end portion toward the other end portion of the shaft may be bent or curved and the case may be bent or curved along a portion which is bent or curved along the one end portion of the shaft.

Yet another exemplary embodiment of the present invention provides a modular training apparatus system including: a shaft; at least one training device including a joint having a diameter larger than that of one end portion of the shaft and disposed at one end portion of the shaft, a joint support contacting the joint and elastically supporting the joint, and a shaft support elastically supporting an outer side of the shaft at the one end portion of the shaft; and a main body to which the training device is coupled.

The main body of the modular training apparatus system may include a set of multiple small main body units coupled by connecting one or more training devices.

The modular training apparatus system may be constituted by a main body and a plurality of projected objects having a predetermined shape, which is coupled with the main body by connecting one or more training devices. The main body may include a plurality of bodies, and a body connection training device elastically connecting the bodies, the body connection training device may include a body shaft, a body joint disposed an end of the body shaft, a body joint support elastically supporting the body joint, and a body shaft support elastically supporting the outer side of the body shaft, and each of the bodies may include a plurality of mounting locations at which the body joint support and the body shaft support are installed so that the body shaft and the body joint are mounted and the bodies are connected by selecting one of the plurality of mounting locations to assemble the main bodies in various shapes.

A plurality of assemblies of the shaft and the joint in the training device may be manufactured so as to correspond to various body parts of a human body and the main body may include a plurality of training device mounting locations at which the joint support and the shaft support are installed so that the shaft and the joint of the training device are mounted, and the assembly of the shaft and the joint may be mounted on the main body by selecting one of the plurality of training device mounting locations to variously change a coupling location of the assembly of the shaft and the joint to the main body.

The modular training apparatus system may further include a base supporting the main body; and a base connection training device installed between the main body and the base to elastically connect the main body to the base.

The modular training apparatus system may further include a head coupled to an upper side of the main body; and a head connection training device installed between the main body and the head to elastically connect the head to the main body.

Moreover, the modular training apparatus system may be manufactured into a body-shaped training apparatus system by embedding the training device having a joint function in unit sandbag units including the main body, the arm, the leg, the foot, the hand, the skull, and the like corresponding to the trunk and assembling the unit sandbag units and the training device.

Advantageous Effects

According to exemplary embodiments of the present invention, in a training device, since a shaft having a joint is elastically supported by a joint support and a shaft support and the shaft and the joint can move with multiple degrees of freedoms, various complex motions can be effectively trained by using the training device.

According to exemplary embodiments of the present invention, by a modular training apparatus system, the training apparatus system can be easily disassembled and assembled by an operation of pulling or pushing the shaft and the joint of the training device.

MODE FOR INVENTION

Hereinafter, configurations and operations of a training device and a modular training apparatus system with the training device according to exemplary embodiments will be described in detail through exemplary embodiments of the accompanying drawings.

Figure 1:
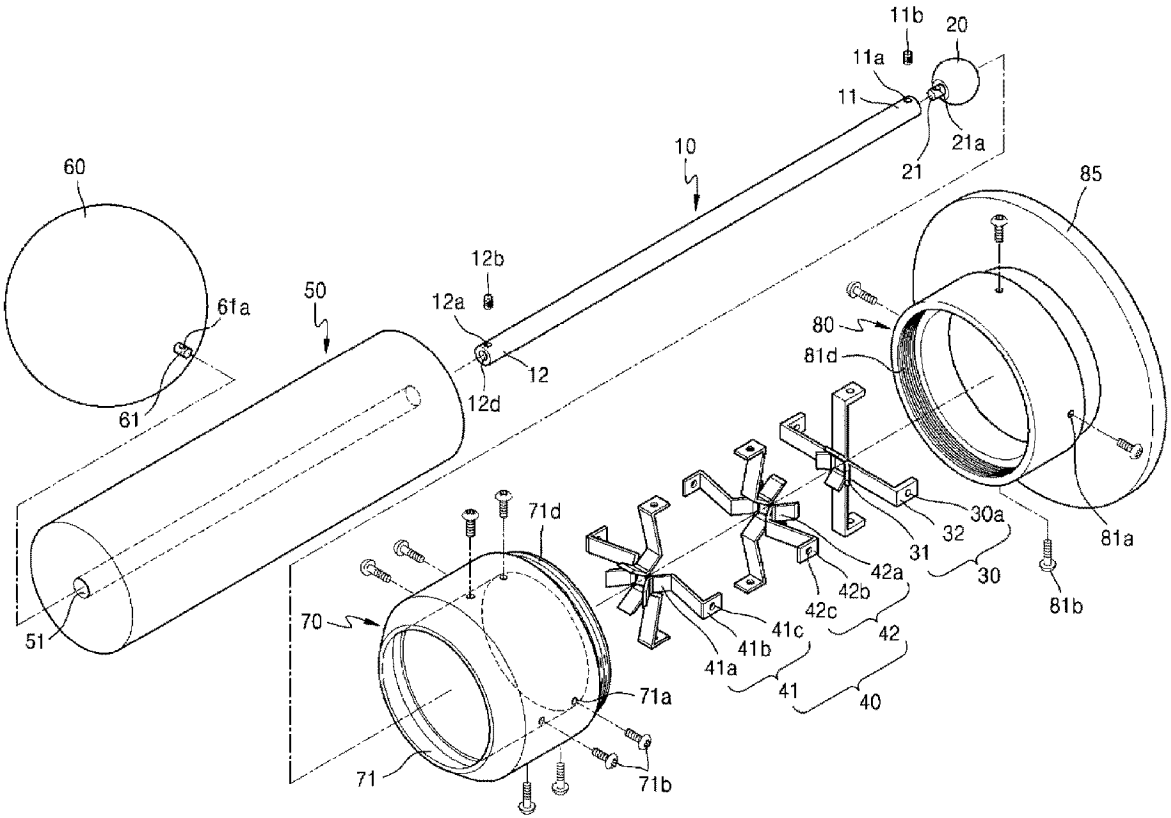
FIG. 1 is a perspective view schematically illustrating a coupling relationship of components of a training device according to an exemplary embodiment.
Figure 2:
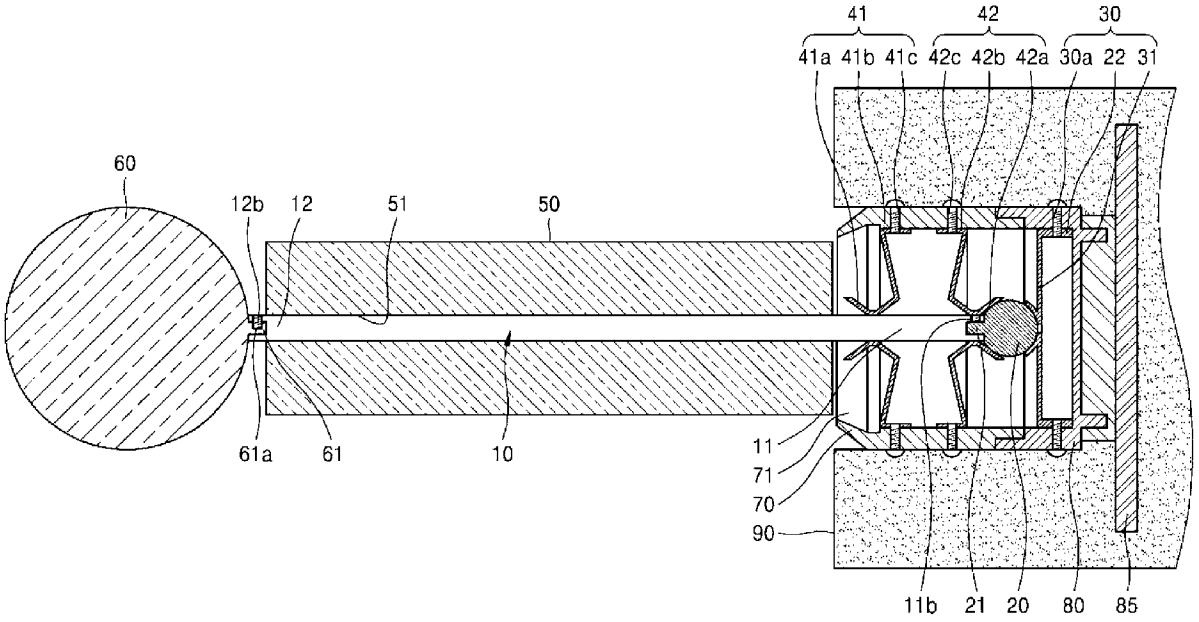
FIG. 2 is a cross-sectional view illustrating a state in which the training device illustrated in FIG. 1 is mounted on a sandbag.

FIG. 1 is a perspective view schematically illustrating a coupling relationship of components of a training device according to an exemplary embodiment and FIG. 2 is a cross-sectional view illustrating a state in which the training device illustrated in FIG. 1 is mounted on a sandbag.

The training device according to the exemplary embodiment illustrated in FIGS. 1 and 2 includes a shaft 10, a joint 20 disposed at one end 11 of the shaft 10, a joint support 30 elastically supporting the joint 20, and a shaft support 40 elastically supporting an outer side of the shaft 10.

The training device having the configuration may be used while being attached to a training product such as a sandbag or attached to a wall of a training room. Referring to FIG. 2, an example is illustrated, in which cases 70 and 80 of the training device are used while being fixed to the sandbag or a wall body 90 of the wall.

The shaft 10 may be made of a solid body having hard rigidity using a metallic or plastic material or may have a circular cross section as illustrated in FIG. 1. Further, the shaft 10 may be manufactured in a columnar shape using a material having slight elasticity, such as a spring made of a steel material, for example. However, the exemplary embodiment is not limited by the configuration of the shaft 10, and for example, the shaft 10 may be manufactured in a form of a hollow-shaped pipe which is hollow and a cross-sectional shape of the shaft 10 may be transformed to various shapes such as a polygon or an oval.

The shaft 10 elongates from one end portion 11 to the other end portion 12 and the joint 20 is disposed at one end portion 11 of the shaft 10. The joint 20 has a diameter larger than the diameter of one end portion 11 of the shaft 10. The joint 20 is also manufactured so that the cross section has a circular, the oval, or polygonal shape and has the hard rigidity by using the metallic or plastic material.

One end portion 11 of the shaft 10 is provided with a groove for receiving a coupling projection 21 of the joint 20. A set screw 11*b* is screwed to a fastening hole 21*a* of the coupling projection 21 of the joint 20 through a coupling hole 11*a* of one end portion 11 of the shaft 10, and as a result, the joint 20 is coupled to one end portion 11 of the shaft 10.

Although it is illustrated in the illustrated exemplary embodiment that the joint 20 and the shaft 10 are separately manufactured and thereafter, assembled, the exemplary embodiment is not limited by a connection structure of the joint 20 and the shaft 10. Therefore, for example, the joint 20 and the shaft 10 may be integrally molded by an injection method or the joint 20 and the shaft 10 may be integrally manufactured by cutting processing.

An impact absorbing part 50 is coupled to the outer side of the shaft 10. The shock absorbing part 50 has an inner cylindrical hollow 51 so as to surround the outer side of the shaft 10. In addition, an outer shape of the shock absorbing part 50 may have various shapes such as a column, a sphere, a polyhedron, or an ellipsoid.

A first part 60 is coupled to the other end portion 12 of the shaft 10. A groove 12*d* accommodating a coupling projection 61 of the first part 60 is provided even at the other end portion 12 of the shaft 10. A set screw 12*b* is screwed to a fastening hole 61*a* of the coupling projection 61 of the first part 60 through a coupling hole 12*a* of the other end portion 12 of the shaft 10, and as a result, the first part 60 is coupled to the other end portion 12 of the shaft 10.

The first part 60 may be made of a material having elasticity or a material having the hard rigidity using metal or a synthetic resin. The outer shape of the first part 60 may include any one of spherical, polyhedral, and ellipsoidal shapes, or may have a three-dimensional shape including a combination of these various shapes.

The joint 20 has a spherical shape. The cross-sectional shape of the joint 20 is not necessarily limited to a circle, and the cross-sectional shape of the joint 20 may be the circle, the ellipse, or the polygon.

In the illustrated exemplary embodiment, the joint support 30 has a concave shape corresponding to a part of an outer surface of the joint 20 when the outer surface of the joint 20 is convex, and has a joint contact portion 31 having elasticity.

Further, in contrast, when the outer surface of the joint 20 is concave, the joint support 30 may have a convex shape corresponding to a part of the outer surface of the joint 20.

The joint support 30 may be manufactured to have the elasticity by a metal plate or a highly elastic plastic or rubber material. The joint support 30 has a joint contact portion 31 that contacts the joint 20 and a rear mounting portion 32 that supports the joint contact portion 31 and is coupled to a rear case 80.

One end portion 11 of the shaft 10 and the joint 20 are accommodated in the cases 70 and 80. The cases 70 and 80 include a front case 70 surrounding one end portion 11 of the shaft 10 and accommodating the shaft support 40 and the rear case 80 supporting the joint support 30 supporting the joint 20. The cases 70 and 80 may be made of, for example, the plastic material or metallic material so as to have the hard rigidity.

The front case 70 has the hollow shape in which the inside is empty and has an opening 71 which opens toward the front. A threaded surface 71*d* is formed on the outer side of a rear portion of the front case 70.

The rear case 80 has a threaded surface 81*d* which is opened frontward and may be coupled to the front case 70. The rear case 80 also has a base 85 at the rear. By mounting the base 85 to the sandbag or the wall, the training device according to the exemplary embodiment may be stably installed on the sandbag or the wall.

The cases 70 and 80 surrounding the one end portion 11 of the shaft 10 and the joint 20 as illustrated in FIG. 2 are completed by screwing the front case 70 and the rear case 80 having the configuration. The front case 70 and the rear case 80 need not particularly be coupled only by a thread coupling structure and for example, the front case 70 and the rear case 80 may be coupled in a shrink fit method by using a projection and a groove or by using an adhesive or coupled by a separate fastening means such as a bolt and a nut, or a rivet.

The rear case 80 has a plurality of through holes 81*a* on a circumferential surface thereof. A plurality of fastening screws 81*b* is coupled to fastening holes 30*a* of the rear mounting portion 32 of the joint support 30 through the through holes 81*a* so that the joint support 30 is stably supported on the rear case 80.

A plurality of the joint supports 30 may be disposed in a circumferential direction of the joint 20. Although it is illustrated in FIG. 1 that four joint supports 30 are disposed, but the exemplary embodiment is not limited by the number of joint supports 30. Therefore, the number of joint supports 30 installed to stably support the joint 20 may be variously modified to 2, 3, 6, 8, etc.

The shaft support 40 includes a first contact portion 42 for elastically supporting an outer edge of one end portion 11 of the shaft 10 and a second contact portion 41 disposed spaced apart from the first contact portion 42 toward the other end portion 12 opposite to one end portion 11 of the shaft 10 to elastically support the outer side of the shaft 10.

As illustrated in FIG. 1, a plurality of first contact portions 42 and second contact portions 41 may be disposed in the circumferential direction of an axial center of the shaft 10. In FIG. 1, it is illustrated that four first contact portions 42 and four second contact portions 41 are each disposed. However, the exemplary embodiment is not limited by the numbers and positions of the first contact portion 42 and the second contact portion 41, and the numbers and positions of the first contact portion 42 and the second contact portion 41 may be variously modi.

Since the first contact portion 42 and the second contact portion 41 are mounted on the front case 70, the front case 70 serves to support the first contact portion 42 and the second contact portion 41 and surround and protect one end portion 11 of the shaft 10.

The first contact portion 42 and the second contact portion 41 may be manufactured to have the same shape. Each of the first contact portion 42 and the second contact portion 41 includes mounting portions 41*b* and 42*b* supported by the front case 70 and elastic portions 41*a* and 42*a* which extend toward the outer side of the shaft 10 from the mounting portions 41*b* and 42*b* to elastically support the outer side of the shaft 10.

Portions of the elastic portions 41*a* and 42*a* which contact the shaft 10 may have a bent or curved shape. The mounting portions 41*b* and 42*b* have fastening holes 41*c* and 42*c*, respectively and the front case 70 has through holes 71*a* corresponding to the fastening holes 41*c* and 42*c*. Therefore, a plurality of fastening screws 71*b* is coupled to the fastening holes 41*c* and 42*c* of the mounting portions 41*b* and 42*b* through the through holes 71*a* so that the first contact portion 42 and the second contact portion 41 of the shaft support 40 are stably supported on the front case 70.

Referring to FIG. 2, the elastic portions 41*a* and 42*a* of the first contact portion 42 and the second contact portion 41 face each other and extend from the mounting portions 41*b* and 42*b* toward the outer side of the shaft 10. The first contact portion 42, the second contact portion 41, and the joint support 30 may support one end portion 11 of the shaft 10 to maintain an installation state of the shaft 10 and the first contact portion 42, the second contact portion 41, and the joint support 30 may be elastically transformed and may stably support the shaft 10 even when force is applied to the shaft 10.

The elastic portion 42*a* of the first contact portion 42 may support one end portion 11 of the shaft 10 and the end of the elastic portion 42*a* may contact the joint 20 and support the joint 20.

Hereinafter, an operation of the training device according to the exemplary embodiment will be described with reference to FIGS. 3 to 6. In FIGS. 3 to 6, the shock absorbing part coupled to the shaft 10 is not illustrated for easy description.

Figure 3:
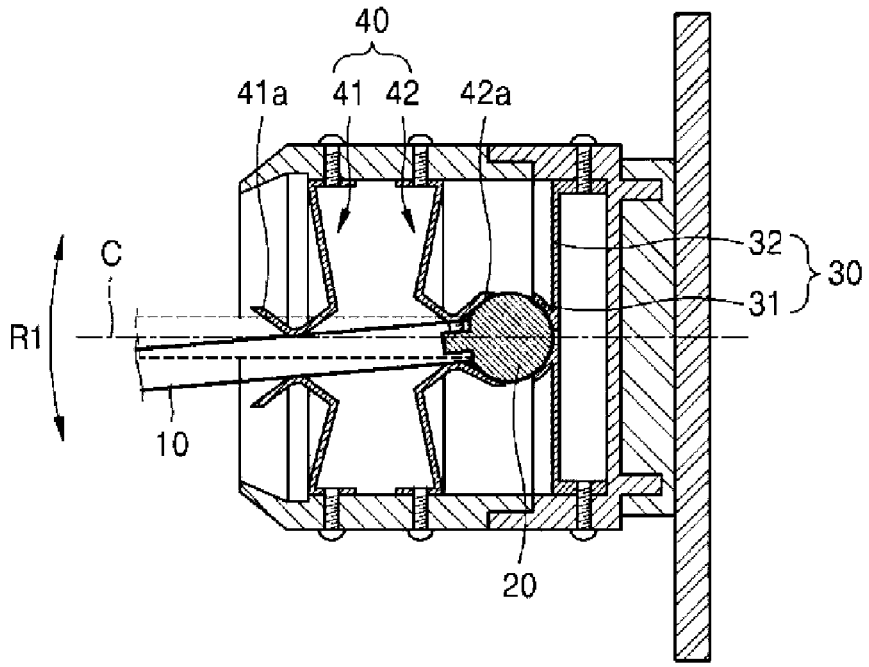
FIG. 3 is a cross-sectional view illustrating one state in which the training device of FIG. 2 operates.

FIG. 3 is a cross-sectional view illustrating one state in which the training device of FIG. 2 operates.

Referring to FIG. 3, force for vertical rotation is applied to the shaft 10, and as a result, the shaft 10 rotates in a vertical rotational direction R1 around the joint 20.

While the shaft 10 rotates around the joint 20 in the vertical rotational direction R1, the first and second contact portions 42 and 41 are elastically transformed so that a gap between the first contact portion 42 and the second contact portion 41 on an upper side in FIG. 3 slightly decreases and the first and second contact portions 42 and 41 are elastically transformed so that the gap between the first contact portion 42 and the second contact portion 41 on a lower side in FIG. 3 slightly increases. The joint 20 may be stably supported by the joint support 30 during the movement of the shaft 10 in the vertical rotational direction R1.

Due to the configuration and operation of the training device described above, a trainee may effectively train a motion similar to breaking the arm of the person by using the training device.

Figure 4:
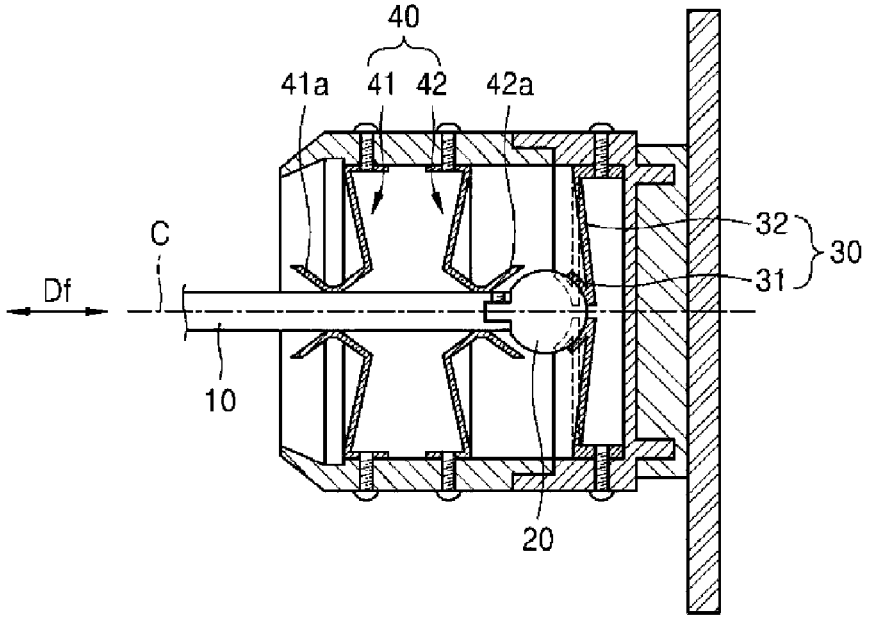
FIG. 4 is a cross-sectional view illustrating another state in which the training device of FIG. 2 operates.

FIG. 4 is a cross-sectional view illustrating another state in which the training device of FIG. 2 operates.

Referring to FIG. 4, an operating state is illustrated in which the shaft 10 is pressed toward the joint support 30 in a direction along a central axis C of the shaft 10.

The joint 20 connected to the shaft 10 presses the joint contact portion 31 and the rear mounting portion 32 of the joint support 30 when the shaft 10 is pressed toward the joint support 30. The joint contact portion 31 of the joint support 30 stably supports the joint 20 while the rear mounting portion 32 is elastically transformed and the first contact portion 42 and the second contact portion 41 stably support the shaft 10.

Accordingly, due to the configuration and operation of the training device described above, the trainee may effectively train a motion similar to pushing the arm of the person toward a shoulder by using the training device.

Figure 5:
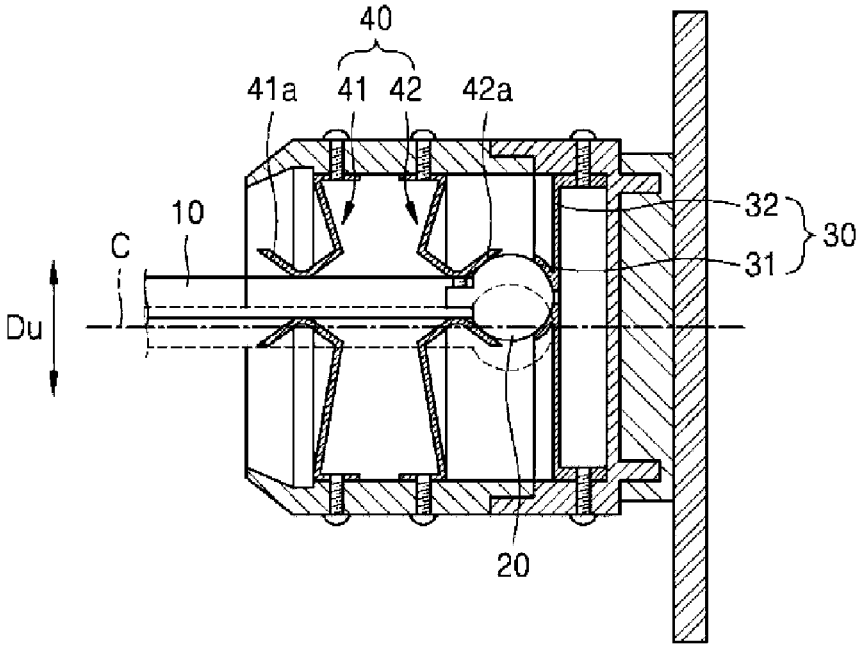
FIG. 5 is a cross-sectional view illustrating yet another state in which the training device of FIG. 2 operates.

FIG. 5 is a cross-sectional view illustrating yet another state in which the training device of FIG. 2 operates.

Referring to FIG. 5, an operating state is illustrated, in which the shaft 10 at an initial position maintains a parallel direction with respect to the central axis C, and presses the shaft 10 up and down and back and forth in a direction of looking at the figure to linearly move the shaft 10 in parallel to the central axis C.

When the entirety of the shaft 10 is pressed upward in the direction Du parallel to the central axis C of the shaft 10, the first contact portion 42 and the second contact portion 41, and a portion of the joint support 30 gripping (contacting) the shaft 10 are elastically transformed. That is, in FIG. 5, the gap between the first contact portion 42 and the second contact portion 41 positioned above the shaft 10 is slightly widened and the gap between the first contact portion 42 and the second contact portion 41 positioned below the shaft 10 is slightly narrowed.

The joint support 30 supporting the joint 20 is also elastically transformed in accordance with the motions of the shaft 10 and the joint 20 so that the contact between the joint 20 and the joint contact portion 31 may be stably maintained.

Accordingly, due to the configuration and operation of the training device described above, the trainee may effectively train a motion similar to pushing or pulling the arm of the person by pressing the arm of the person in vertical and horizontal directions of the body by gripping the arm of the person with two hands by using the training device.

Figure 6:
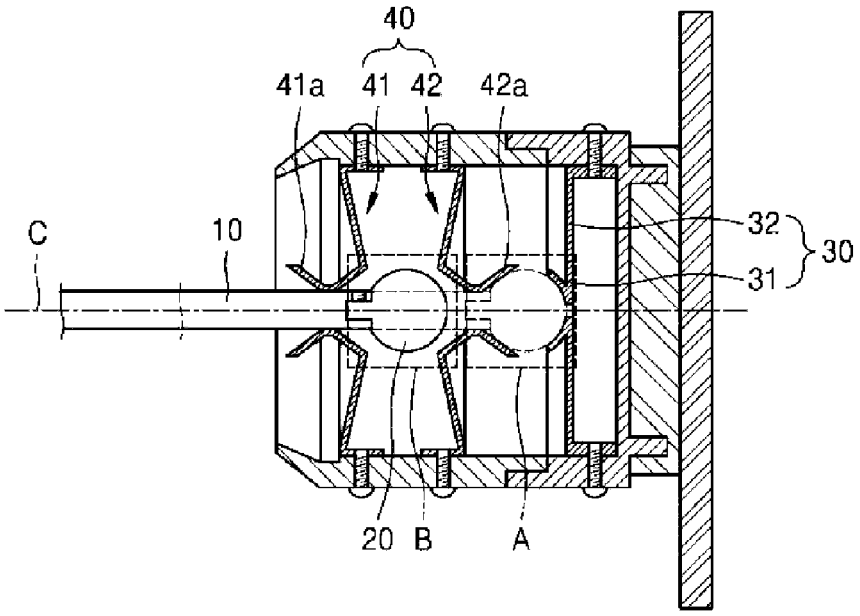
FIG. 6 is a cross-sectional view illustrating another state in which the training device of FIG. 2 operates.

FIG. 6 is a cross-sectional view illustrating another state in which the training device of FIG. 2 operates.

Referring to FIG. 6, the operating state is illustrated in which the shaft 10 is pulled in a direction away from the joint support 30 along the central axis C of the shaft 10.

When the shaft 10 placed at an assembly position A expressed by a dotted line in FIG. 6 is pulled strongly in the direction away from the joint support 30 so as to be spaced apart from the joint support 30, the elastic portion 42*a* of the first contact portion 42 contacting the joint 20 is widened and the joint 20 and the shaft 10 may thus move to a separation space B between the first contact portion 42 and the second contact portion 41.

The joint 20 which moves to the separation space B may be supported by the elastic portion 41*a* of the second contact portion 41 so as not to be separated to the outer side of the case. That is, in the separation space B, the joint 20 is supported between the first contact portion 42 and the second contact portion 41.

When the shaft 10 and the joint 20 are to be completely separated from the cases 70 and 80 of the training device, the shaft 10 is strongly pulled in the direction further away from the joint support 30 along the central axis C again.

Conversely, when the shaft 10 of the training device completely separated from the case is assembled to the case again, the joint 20 of the shaft 10 is strongly inserted between the elastic portions 41*a* of the second contact portion 41 to move the joint 20 to the separation space B and thereafter, the joint 20 of the shaft 10 is strongly inserted again into the elastic portion 42*a* of the first contact portion 42 to move the joint 20 to the assembly position A.

Accordingly, due to the configuration and operation of the training device described above, a trainee may effectively train a motion of applying force enough to extract the arm of the person from the shoulder by using the training device.

Further, the operation of disassembling or assembling the training device may be simplified by a simple operation of pulling the shaft 10 or strongly inserting the shaft 10 into the shaft support 40. With such a configuration of the training device, it is possible to realize a modular sandbag which is easy to disassemble and assemble and has excellent expandability by using the training device according to the exemplary embodiment.

Figure 7:
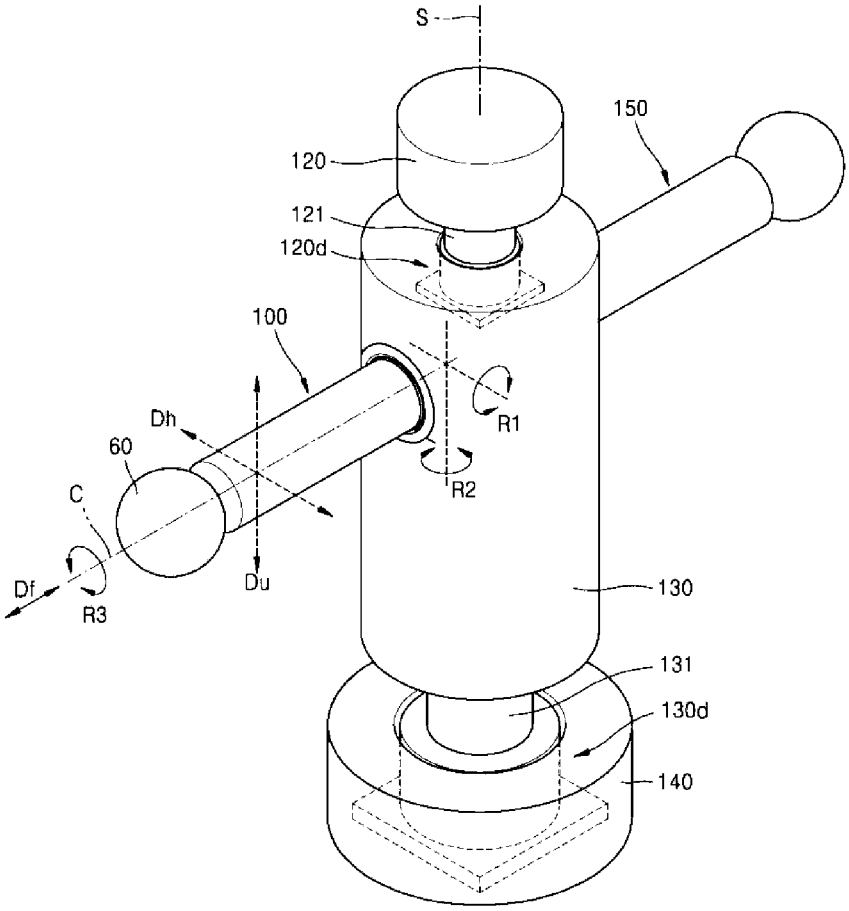
FIG. 7 is a perspective view of a modular training apparatus system with a training device according to another exemplary embodiment.

FIG. 7 is a perspective view of a modular training apparatus system with a training device according to another exemplary embodiment.

The training apparatus system with a training device according to the exemplary embodiment illustrated in FIG. 7 is exemplified as a modulator sandbag. The training apparatus system includes a first training device 100 and a second training device 150 corresponding to the arms of the person, and a body 130 coupled to each of the first and second training devices 100 and 150 and corresponding to the trunk of the person.

Although not illustrated in FIG. 7 for easy description, each of the first training device 100 and the second training device 150 may have the same configuration as the training device according to the exemplary embodiment illustrated in FIGS. 1 to 6.

In other words, each of the first training device 100 and the second training device 150 may include a shaft, a joint coupled to one end portion of the shaft, a joint support elastically supporting the joint, and a shaft support elastically supporting the outer side of the shaft at one end portion of the shaft and the first parts 60 are disposed at the other end portions of the first and second training devices 100 and 150.

A head 120 corresponding to the head of the person is installed on the upper side of a main body 130 and a head connection training device 120*d* adopting the same configuration as the training device according to the exemplary embodiment illustrated in FIGS. 1 to 6 is installed between the head 120 and the main body 130. That is, the head connection training device 120*d* includes a joint that is coupled to one end portion of a shaft 121 of the head 120 and embedded in the main body 130, a shaft support embedded in the main body 130 to elastically support one end portion of the shaft 121, and a joint support embedded in the main body 130 to elastically support the joint.

The main body 130 may be elastically supported by a base 140 installed on a floor. A base connection training device 130*d* employing the configuration of the training device according to the exemplary embodiment illustrated in FIGS. 1 to 6 may be installed between the main body 130 and the base 140. That is, by the base connection training device 130*d*, a shaft 131 of the main body 130 and the joint coupled to one end portion of the shaft 131 may be elastically supported by the joint support and the shaft support embedded in the base 140.

According to the modular sandbag having the configuration, the main body 130 may be easily assembled to the base 140 or the main body 130 may be easily separated from the base 140. Further, the first training device 100, the second training device 150, the head 120, and the like may be easily assembled to or separated from the main body 130.

The main body 130 may be elastically supported on the base 140 and move elastically around a vertical axis S and the head 120 may be elastically supported on the main body 130 and move elastically around the vertical axis S.

Since the first training device 100 and the second training device 150 are elastically supported on the main body 130, the first training device 100 and the second training device 150 may move elastically with respect to the main body 130.

The movement of each training device based on the first training device 100 illustrated in FIG. 7 will be described. The first training device 100 may rotate with respect to the main body 130 in the vertical rotational direction R1 or in a horizontal rotational direction R2 or in an axis rotational direction R3 around the central axis C of the first training device 100 and may move in a forward and backward linear direction Df along the central axis C of the first training device 100 or move linearly in a vertical linear direction Du or a horizontal linear direction Dh parallel to the central axis C of the first training device 100.

According to the modular sandbag having the configuration, the first training device 100, the second training device 150, and the head 120 may perform rotational movement in three directions, respectively with respect to the main body 130 and perform linear movement in three directions. Similarly, the main body 130 may move with respect to the base 140 with six degrees of freedom. Therefore, the trainee may perform effective training by assuming a situation maximally similar to practical training using the sandbag provided with the training device.

Figure 8:
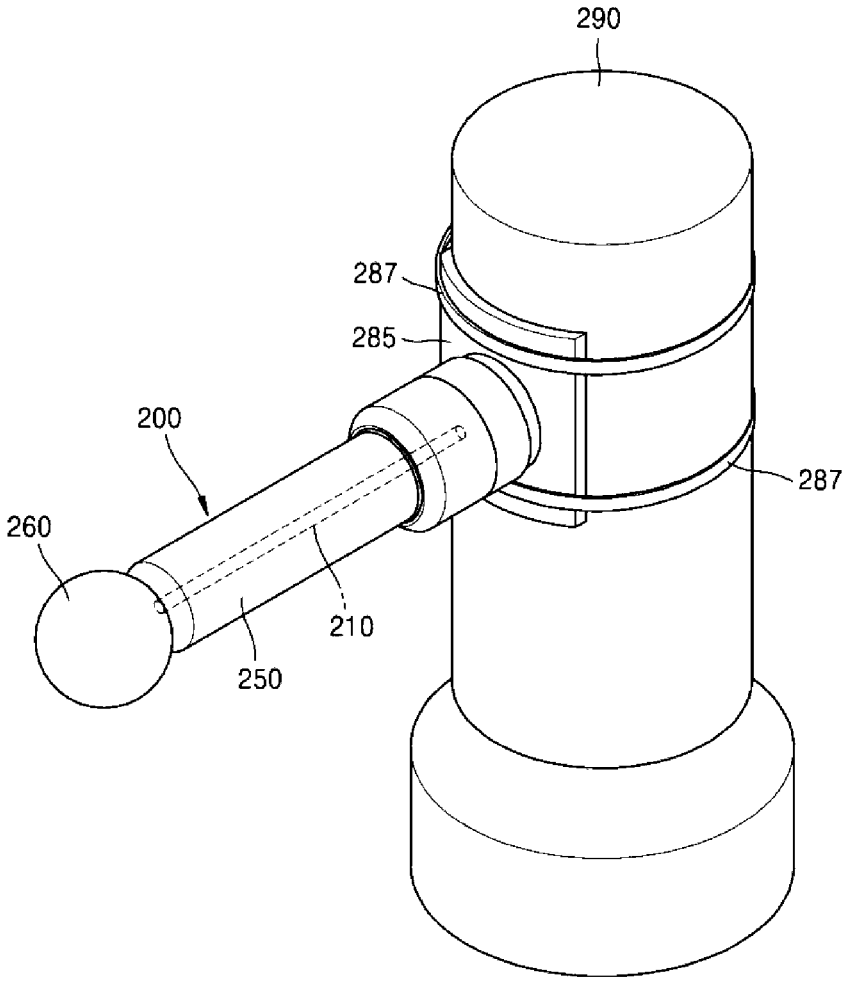
FIG. 8 is a perspective view of a modular training apparatus system with a training device according to another exemplary embodiment.

FIG. 8 is a perspective view of a modular training apparatus system with a training device according to another exemplary embodiment.

The modular training apparatus system according to the exemplary embodiment illustrated in FIG. 8 is exemplified as the modulator sandbag. The training apparatus system includes a main body 290 and a training device 200 coupled to the main body 290. The training device 200 has the same structure as the training device according to the exemplary embodiment illustrated in FIGS. 1 to 6. That is, the training device 200 includes a shaft 210, a joint coupled to one end portion of the shaft 210, a joint support elastically supporting the joint, a shaft support supporting the outer side of one end portion of the shaft 210. A first part 260 is coupled to the other end portion of the shaft 210 and an impact absorbing part 250 is coupled to the outer side of the shaft 210.

The case of the training device 200 has a base 285 which is curved to correspond to a curved outer surface of the main body 290 of the sandbag at the rear. A band 287 is wound around the main body 290 and the base 285 in a state where the base 285 is in contact with the outer side of the main body 290 when the training device 200 is coupled to the main body 290. Thus, the training device 200 can be easily and stably installed on the main body 290 of the sandbag.

The base 285 of the training device 200 is coupled to the main body 290 using the band 287 in the exemplary embodiment illustrated in FIG. 8 but the exemplary embodiment is not limited by such a coupling means such as the band 287 and various fastening means such as bolts or adhesives or pins may be used.

Figure 9:
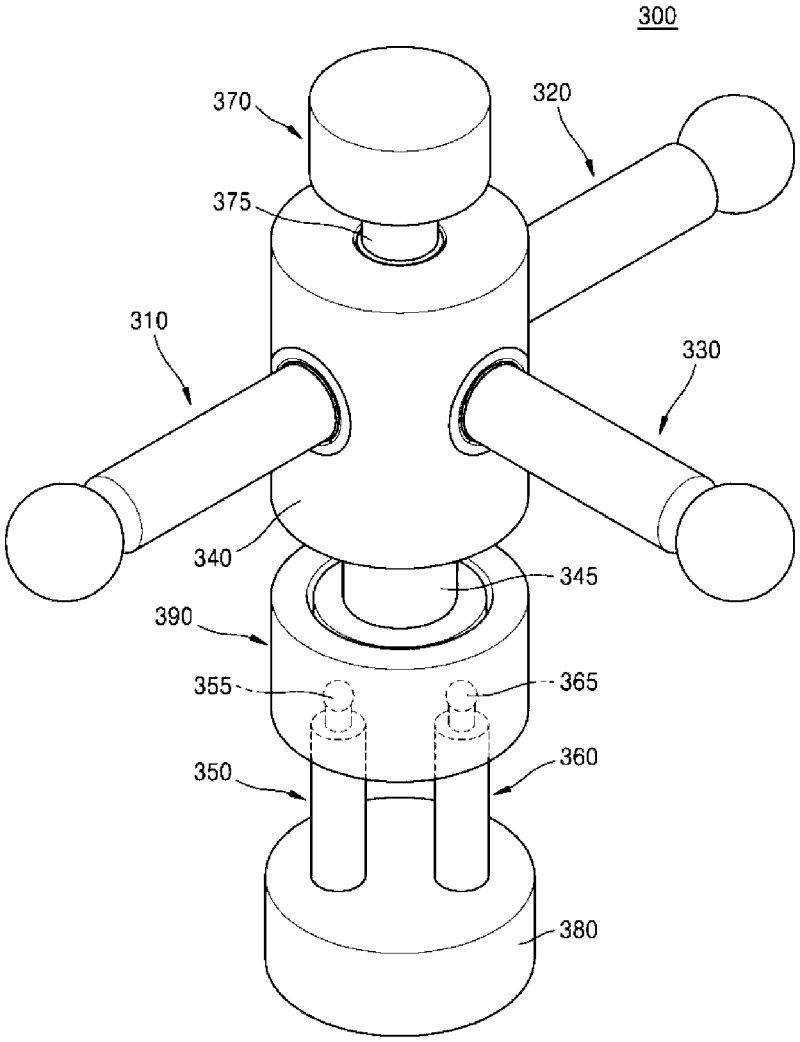
FIG. 9 is a perspective view of a modular training apparatus system with a training device according to yet another exemplary embodiment.

FIG. 9 is a perspective view of a modular training apparatus system with a training device according to yet another exemplary embodiment.

The training device according to the exemplary embodiment illustrated in FIG. 9 is exemplified as a modulator sandbag 300. The modular sandbag 300 includes a first training device 310, a second training device 320, and a third training device 330, corresponding to the arms of the person and a main body 340 elastically supporting each of the first, second, and third training devices 310, 320, and 330 and corresponding to the trunk of the person.

Although not illustrated in FIG. 9 for easy description, each of the first training device 310, the second training device 320, and the third training device 330 may have the same configuration as the training device according to the exemplary embodiment illustrated in FIGS. 1 to 6.

A head 370 corresponding to the head of the person is installed on the upper side of the main body 340 and a head connection training device adopting the configuration of the training device according to the exemplary embodiment illustrated in FIGS. 1 to 6 is installed between the head 370 and the main body 340. That is, the joint is coupled to one end portion of a shaft 375 of the head 370 to be embedded in the main body 340 and one end portion of the shaft 375 may be elastically supported by a shaft support embedded in the main body 340 and the joint may be elastically supported by the joint support embedded in the main body 340.

The main body 340 may be elastically supported by a base 390. A base connection training device employing the configuration of the training device according to the exemplary embodiment illustrated in FIGS. 1 to 6 may be installed between the main body 340 and the base 390. That is, a shaft 345 of the main body 340 and the joint coupled to one end portion of the shaft 345 may be elastically supported by the joint support and the shaft support embedded in the base 390.

A lower portion of the base 390 is connected to a fixing portion 380 installed on the floor. Between the base 390 and the fixing portion 380, third and fourth training devices 350 and 360 having the same configuration as the training device according to the exemplary embodiment illustrated in FIGS. 1 to 6 are installed. The third and fourth training devices 350 and 360 are provided with shafts having joints 355 and 365, respectively at one end portion thereof and the shafts may be elastically supported by a shaft support embedded in the base 390 and the joints 355 and 365 may be elastically supported by the joint support embedded in the base 390.

Figure 10:
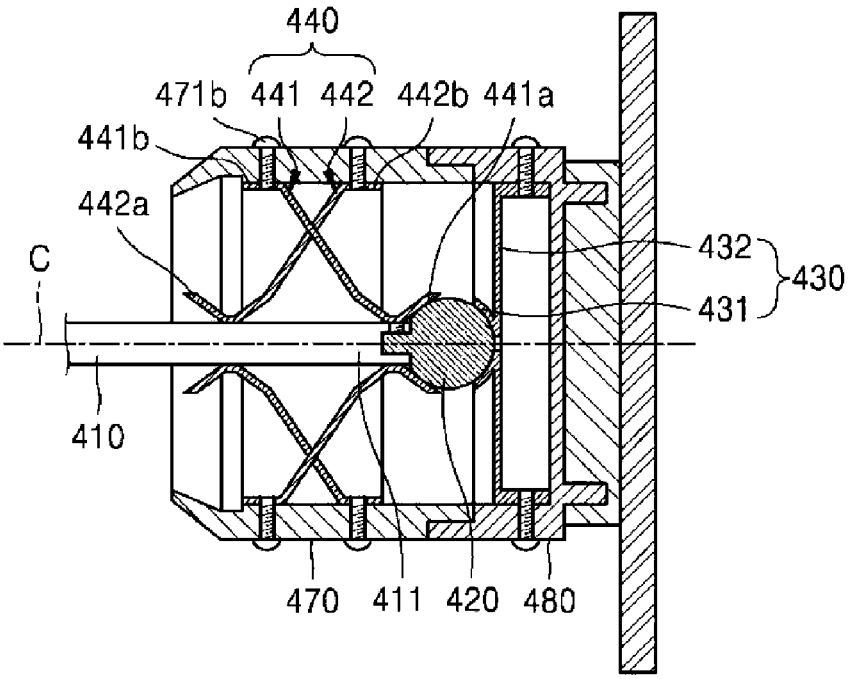
FIG. 10 is a cross-sectional view illustrating a part of the training device according to yet another exemplary embodiment.

FIG. 10 is a cross-sectional view illustrating a part of the training device according to yet another exemplary embodiment.

The training device according to the exemplary embodiment illustrated in FIG. 10 has a configuration similar to that of the training device according to the exemplary embodiment illustrated in FIGS. 1 to 6 as a whole and has modified specific configurations of a first contact portion 442 and a second contact portion 441.

The training device according to the exemplary embodiment illustrated in FIG. 10 includes a shaft 410, a joint 420 disposed at one end portion 411 of the shaft 410, a joint support 430 elastically supporting the joint 420, and a shaft support 440 elastically supporting the outer side of the shaft 410.

The joint support 430 elastically supporting the joint 420 has a joint contact portion 431 that contacts the joint 420 and a rear mounting portion 432 that supports the joint contact portion 431 and is coupled to cases 470 and 480.

One end portion 411 of the shaft 410 and the joint 420 are accommodated in the cases 470 and 480. The cases 470 and 480 include a front case 470 surrounding one end portion 411 of the shaft 410 and a rear case 480 accommodating the joint support 430 supporting the joint 420.

The shaft support 440 includes a first contact portion 442 for elastically supporting the outer side of one end portion 411 of the shaft 410 and a second contact portion 441 disposed spaced apart from the first contact portion 442 toward an opposite side to one end portion 411 of the shaft 410 to elastically support the outer side of the shaft 410.

The first contact portion 442 and the second contact portion 441 include mounting portions 441*b* and 442*b* coupled to the front case 470 by fastening screws 471*b* and elastic portions 441*a* and 442*a* which extend toward the outer side of the shaft 410 from the mounting portions 441*b* and 442*b* to elastically support the outer side of the shaft 410, respectively.

The mounting portion 442*b* of the first contact portion 442 is disposed at a position corresponding to one end portion 411 of the shaft 410 in the front case 470 and the mounting portion 441*b* of the second contact portion 441 is disposed at a position spaced apart from the mounting portion 442*b* of the first contact portion 442 to the other end portion of the shaft 410 in the front case 470.

The elastic portion 442*a* of the first contact portion 442 extends toward the opposite side of the one end portion 411 of the shaft 410, that is, toward the other end portion. The elastic portion 441*a* of the second contact portion 441 extends from the mounting portion 441*b* of the second contact portion 441 toward the one end portion 411 of the shaft 410. Therefore, the elastic portion 441*a* of the second contact portion 441 and the elastic portion 442*a* of the first contact portion 442 may contact the shaft portion 410 by extending in directions crossing each other.

The elastic portion 441*a* of the second contact portion 441 may support one end portion 411 of the shaft 410 and the end of the elastic portion 441*a* may support the joint 420.

Since the elastic portions 441*a* and 442*a* of the first and second contact portions 442 and 441 extend in the directions crossing each other to elastically support one end portion 411 of the shaft 410 according to the training device having the configuration, the shaft 410 may be more stably supported by the shaft support 440.

Figure 11:
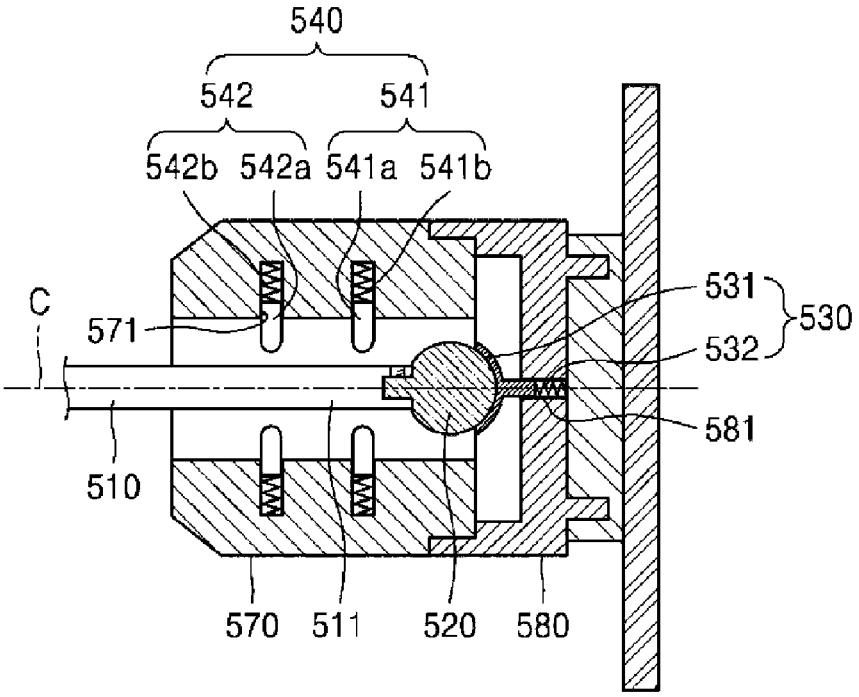
FIG. 11 is a cross-sectional view illustrating a part of the training device according to still yet another exemplary embodiment.

FIG. 11 is a cross-sectional view illustrating a part of the training device according to still yet another exemplary embodiment.

The training device according to the exemplary embodiment illustrated in FIG. 11 has a configuration similar to that of the training device according to the exemplary embodiment illustrated in FIGS. 1 to 6 as a whole and has modified specific configurations of a first contact portion 541 and a second contact portion 542.

The training device according to the exemplary embodiment illustrated in FIG. 11 includes a shaft 510, a joint 520 disposed at one end portion 511 of the shaft 510, a joint support 530 elastically supporting the joint 520, and a shaft support 540 elastically supporting the outer side of the shaft 510.

The joint support 530 elastically supporting the joint 520 includes a joint slider 531, which is in contact with the joint 520 and is slidably mounted on a groove 581 of a rear case 580, and a joint elastic support 532 disposed at the groove 581 of the rear case 580 so as to elastically support the joint slider 531.

The shaft support 540 includes a first contact portion 541 for elastically supporting the outer side of one end portion 511 of the shaft 510 and a second contact portion 542 disposed spaced apart from the first contact portion 541 toward an opposite side to one end portion 511 of the shaft 510 to elastically support the outer side of the shaft 510.

The first contact portion 541 and the second contact portion 542 has shaft sliders 541*a* and 542*a* slidably installed on the groove 571 of the front case 570 so as to be movable toward the outer side of the shaft 510 and shaft elastic support portions 541*b* and 542*b* which are disposed in the groove 571 so as to elastically support the shaft sliders 541*a* and 542*a* with respect to the front case 570, respectively. The shaft sliders 541*a* and 542*a* may be manufactured into a rod or a cylinder which is hard or has slight elasticity, such as metal, plastic, rubber, a synthetic resin, or the like.

The shaft elastic supports 541*b* and 542*b* and the joint elastic support 532 of the training device according to the exemplary embodiment illustrated in FIG. 11 are illustrated as compression coil springs, but the exemplary embodiment is limited by the configurations of the shaft elastic supports 541*b* and 542*b*, and the joint elastic support 532. Therefore, in addition to the compression coil springs, the shaft elastic supports 541*b* and 542*b* and the joint elastic support 532 may be implemented by using a cylinder filled with a compressible fluid such as gas, a magnet having magnetic force, or an elastic material such as rubber.

According to the training device having the configuration, the shaft 510 may move with various degrees of freedom as in the training device according to the exemplary embodiment illustrated in FIGS. 1 to 6 and 10 and the shaft 510 and the joint 520 are elastically supported by the joint support 530 and the shaft support 540. Therefore, various motions using the training device may be trained and the training device may be disassembled or assembled by a simple operation.

Figure 12:
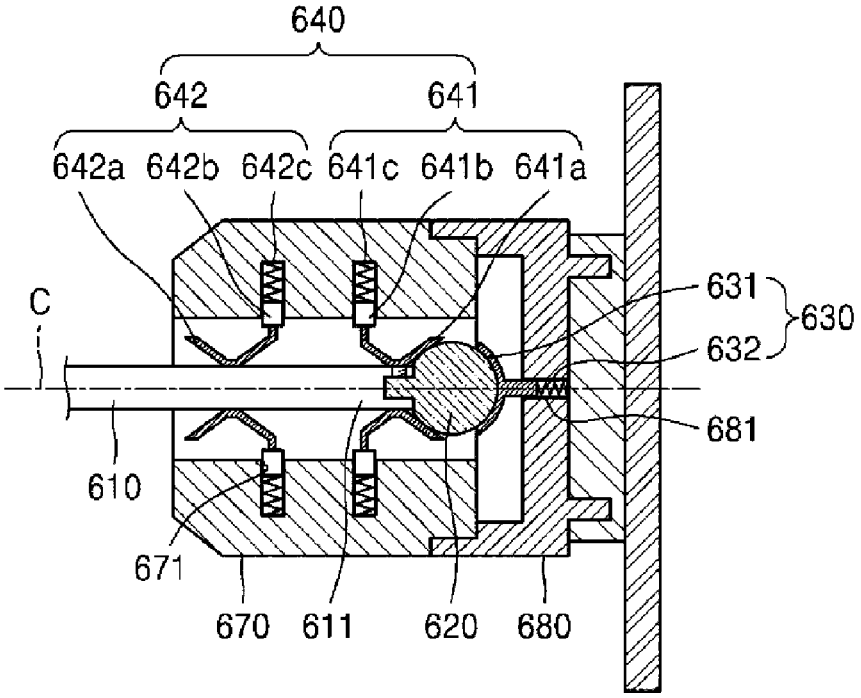
FIG. 12 is a cross-sectional view illustrating a part of the training device according to still yet another exemplary embodiment.

FIG. 12 is a cross-sectional view illustrating a part of the training device according to still yet another exemplary embodiment.

The training device according to the exemplary embodiment illustrated in FIG. 12 has a configuration similar to that of the training device according to the exemplary embodiment illustrated in FIG. 11 as a whole and has modified specific configurations of a first contact portion 641 and a second contact portion 642.

The training device according to the exemplary embodiment illustrated in FIG. 12 includes a shaft 610, a joint 620 disposed at one end portion 611 of the shaft 610, a joint support 630 elastically supporting the joint 620, and a shaft support 640 elastically supporting the outer side of the shaft 610.

The joint support 630 elastically supporting the joint 620 includes a joint slider 631, which is in contact with the joint 620 and is slidably mounted on a groove 681 of a rear case 680, and a joint elastic support 632 disposed at the groove 681 of the rear case 680 so as to elastically support the joint slider 631.

The shaft support 640 includes a first contact portion 641 for elastically supporting the outer side of one end portion 611 of the shaft 610 and a second contact portion 642 disposed spaced apart from the first contact portion 641 toward an opposite side to one end portion 611 of the shaft 610 to elastically support the outer side of the shaft 610.

The first contact portion 641 and the second contact portion 642 have shaft sliders 641*b* and 642*b* slidably installed on the groove 671 of the front case 670 so as to be movable toward the outer side of the shaft 610, shaft elastic supports 641*c* and 642*c* which are disposed in the groove 671 so as to elastically support the shaft sliders 641*b* and 642*b* with respect to the front case 670, and elastic portions 641*a* and 642*a* coupled to the end portions of the shaft sliders 641*b* and 642*b*, respectively to elastically contact the outer side of the shaft 610.

According to the training device having the configuration, like the training device according to the exemplary embodiment illustrated in FIGS. 1 to 6, 10, and 11, the shaft 610 may move with various degrees of movement freedom described above and the shaft 610 and the joint 620 are elastically supported by the joint support 630 and the shaft support 640. Therefore, various motions using the training device may be trained and the training device may be disassembled or assembled by a simple operation.

Figure 13:
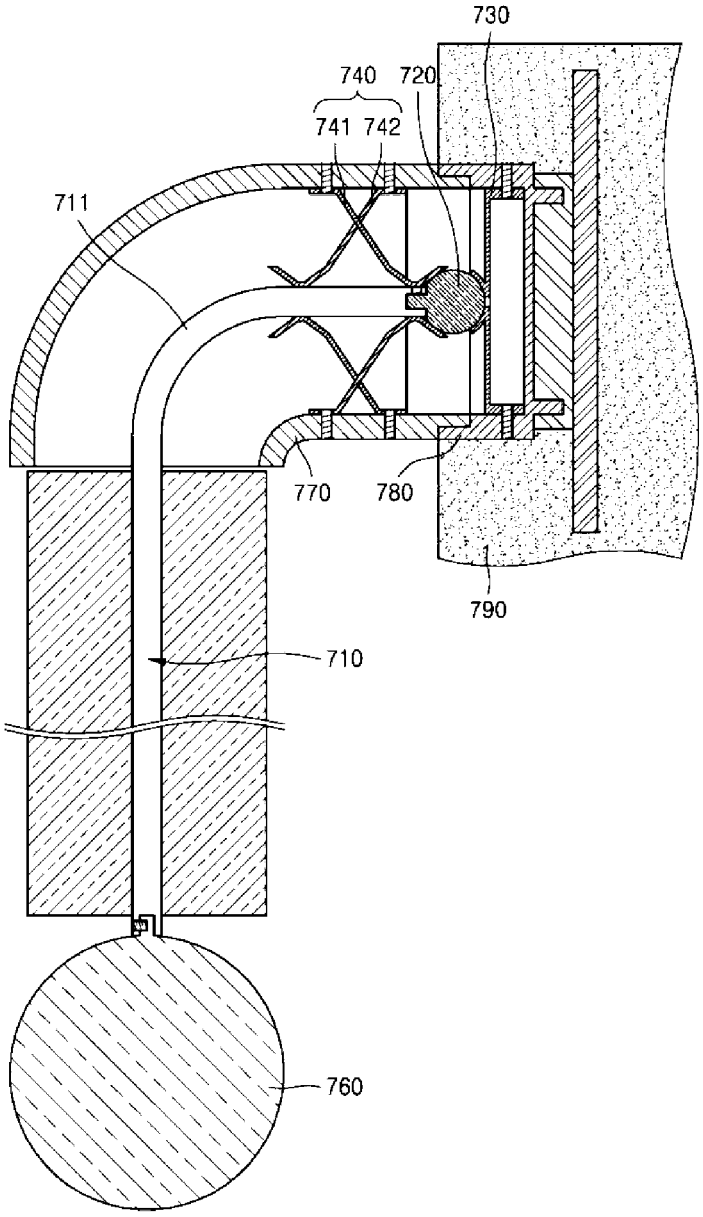
FIG. 13 is a cross-sectional view illustrating a part of the training device according to still yet another exemplary embodiment.

FIG. 13 is a cross-sectional view illustrating a part of the training device according to still yet another exemplary embodiment.

The training device according to the exemplary embodiment illustrated in FIG. 13 has a configuration similar to that of the training device according to the exemplary embodiment illustrated in FIG. 11 as a whole and is modified so that one end portion 711 of a shaft 710 is curved and a part of a case 770 is curved.

The training device according to the exemplary embodiment illustrated in FIG. 13 includes a shaft 710, a joint 720 disposed at one end portion 711 of the shaft 710, a joint support 730 elastically supporting the joint 720, and a shaft support 740 elastically supporting the outer side of the shaft 710. A first part 760 is coupled to the other end portion of the shaft 710.

The joint support 730 elastically supporting the joint 720 is installed in a rear case 780 which is in contact with the joint 720 and is coupled to the rear of a case 770. The rear case 780 is coupled to the sandbag or a wall body 790 of the wall.

The shaft support 740 includes a first contact portion 742 elastically supporting the outer side of one end portion 711 of the shaft 710 and a second contact portion 741 disposed to be spaced apart from the first contact portion 742 toward an opposite side to one end portion 711 of the shaft 710 to elastically support the outer side of the shaft 710.

One end portion 711 of the shaft 710 and the joint 720 are accommodated in the cases 770. One end portion 711 of the shaft 710 accommodated in the case 770 has a curved portion that is curved in part. The case 770 also has a curved portion which is curved along the curved portion of one end portion 711 of the shaft 710.

According to the training device having the configuration, since one end portion 711 of the shaft 710 is curved and the case 770 accommodating one end portion 711 of the shaft 710 is also curved, an overall configuration of the training device may maintain a shape similar to an actual shoulder of the person. As a result, the trainee may effectively perform a training close to an actual match by using the training device.

Figure 14:
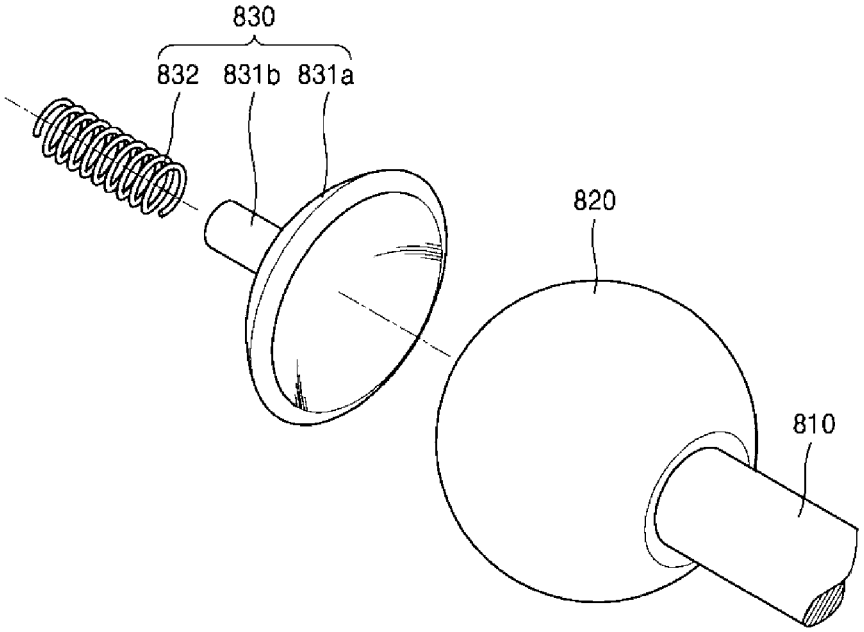
FIG. 14 is a perspective view illustrating a part of the training device according to still yet another exemplary embodiment.

FIG. 14 is a perspective view illustrating a part of the training device according to still yet another exemplary embodiment.

FIG. 14 illustrates an example of a joint support 830 applied to a training device according to the exemplary embodiment illustrated in FIGS. 11 and 12, for example. The joint support 830 includes a joint slider 831*a* that contacts a spherical joint 820 coupled to one end portion of a shaft 810 and a joint elastic support 832 that is coupled to a rearward projection 831*b* of the joint slider 831*a* and installed in a case (not illustrated) so as to elastically support the joint slider 831*a*.

According to the training device having the joint support 830 having the configuration, since the joint slider 831*a* is pressed against the joint 820 by the elastic force of the joint elastic support 832, the joint 820 is stably supported by a concave groove formed in front of the joint slider 831*a*. The overall operation of the training device may be stabilized by the configuration of the joint support 830.

Figure 15:
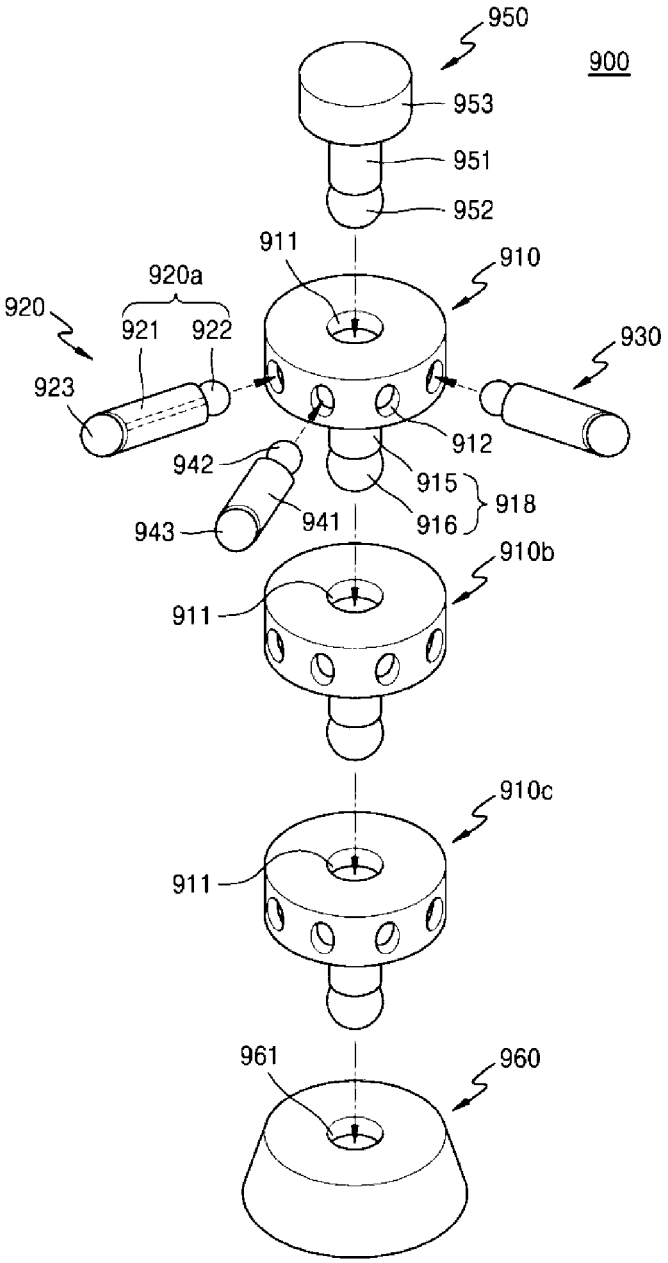
FIG. 15 is a perspective view schematically illustrating a coupling relationship of components of a modular training apparatus system according to still yet another exemplary embodiment.

FIG. 15 is a perspective view schematically illustrating a coupling relationship of components of a modular training apparatus system according to still yet another exemplary embodiment.

In the modular training apparatus system 900 according to the exemplary embodiment illustrated in FIG. 15, the main body is assembled by connecting a plurality of bodies 910, 910*b*, and 910*c*. Each of the bodies 910, 910*b*, and 910*c* includes a body joint assembly 918 having a body shaft 915 and a body joint 916 disposed at an end of the body shaft 915. Each of the bodies 910, 910*b*, and 910*c* also has a mounting location 911 for accommodating the body joint assembly 918. A body shaft support for supporting the body shaft 915 and a body joint support for supporting the body joint 916 are installed in the mounting location 911.

The bodies 910, 910*b*, and 910*c* have a plurality of training device mounting locations 912 on which training devices 920, 930, and 940 are mounted, respectively.

The training devices 920 and 930 corresponding to the arms of the person include a shaft 921, a joint 922 coupled to one end portion of the shaft 921, an assembly 920*a* of the shaft and the joint, which has a first part 923 coupled to the other end portion of the shaft 921, and a shaft support and a joint support which are mounted in a training device mounting location 912. The assembly 920*a* of the shaft and the joint may be mounted by selecting any one of a plurality of training device mounting locations 912.

The training device 940 corresponding to the first of the person may also include a first part 943, a shaft 941, and a joint 942 and may be mounted on the plurality of training device mounting locations 912.

A head training device 950 having a shaft 951, a joint 952, and a head 953 may be mounted on the uppermost body 910.

Further, the lowermost body 910*c* may be mounted on a coupling location 961 of a base 960 installed on the floor.

Figure 16:
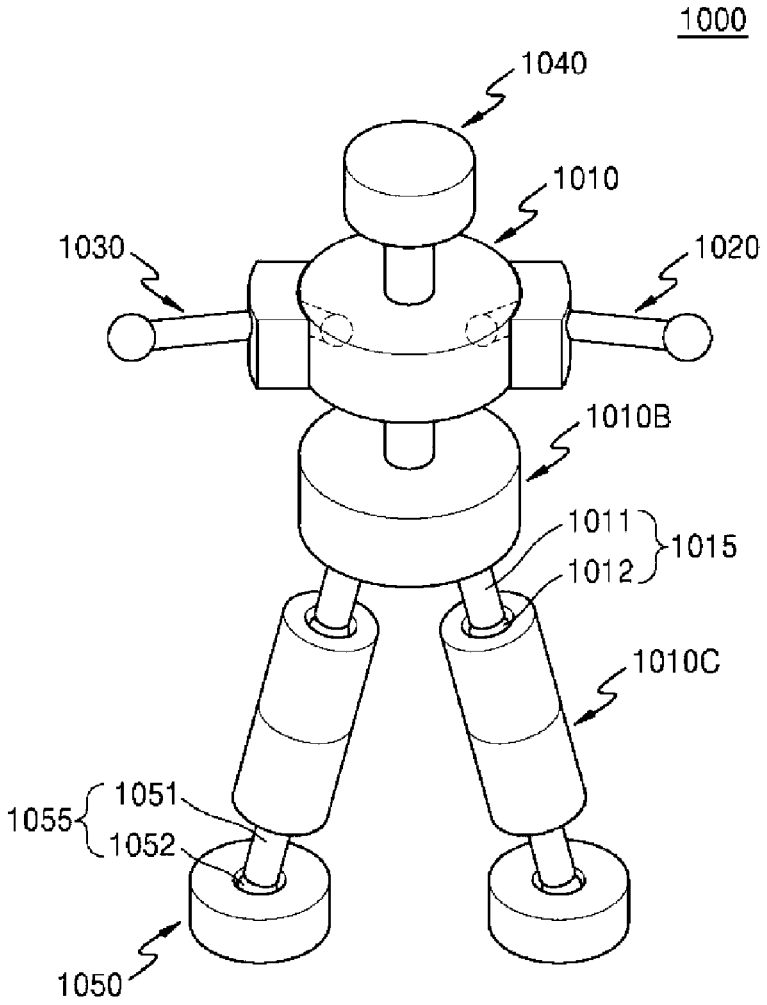
FIG. 16 is a perspective view schematically illustrating a coupling relationship of the components of the modular training apparatus system according to still yet another exemplary embodiment.

FIG. 16 is a perspective view schematically illustrating a coupling relationship of the components of the modular training apparatus system according to still yet another exemplary embodiment.

In the modular training apparatus system 1000 according to the exemplary embodiment illustrated in FIG. 16, the main body is completed by assembling a plurality of bodies 1010, 10108, and 1010C. Training devices 1020 and 1030 corresponding to the arms of the person are installed at left and right sides of the upper body 1010 and a head training device 1040 corresponding to the head of the person is installed on an upper portion.

The central body 1010B is coupled to the lower body 1010C by an assembly 1015 of the body shaft and joint, which includes a body shaft 1011 and a body joint 1012. The lower body 1010C may perform a function corresponding to the leg of the person.

The lower body 1010C is coupled to bases 1050 and 1060 supported on the floor by an assembly 1055 of the body shaft and joint, which includes a body shaft 1051 and a body joint 1052.

According to the modular training apparatus system having the configuration described in the exemplary embodiment illustrated in FIGS. 15 and 16, joint function training devices of the present invention are embedded in unit sandbag units such as the main body, the arm, the leg, feet, hands, and a skull corresponding to the trunk of the person and assembled to be manufactured into a body-shaped training apparatus system.

Figure 17:
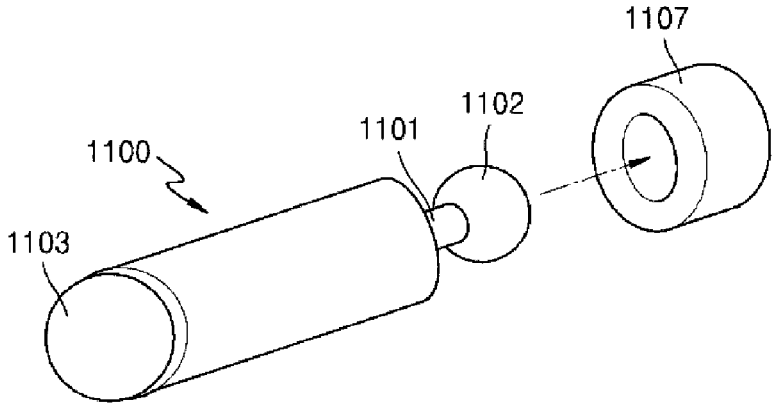
FIG. 17 is a perspective view schematically illustrating a coupling relationship of the components of the training device applicable to the modular training apparatus system according to the exemplary embodiment illustrated in FIGS. 15 and 16.

FIG. 17 is a perspective view schematically illustrating a coupling relationship of the components of the training device applicable to the modular training apparatus system according to the exemplary embodiment illustrated in FIGS. 15 and 16.

A joint assembly 1100 including a shaft 1101, a joint 1102, and a first part 1103 may be elastically coupled to mounting elements 1107 that may be embedded in or coupled to the body, for example. The shaft support and the joint support of the training device according to the exemplary embodiment illustrated in FIGS. 1 to 6 are installed in the mounting elements 1107.

Figure 18:
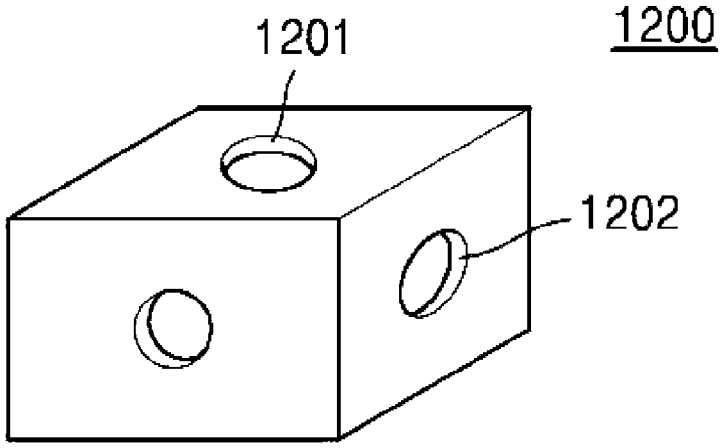
FIG. 18 is a perspective view illustrating one example of the body applicable to the modular training apparatus system according to the exemplary embodiment illustrated in FIGS. 15 and 16.

FIG. 18 is a perspective view illustrating one example of the body applicable to the modular training apparatus system according to the exemplary embodiment illustrated in FIGS. 15 and 16.

A body 1200 according to the exemplary embodiment shown in FIG. 18 includes mounting locations 1201 having a square hexahedron or rectangular parallelepiped shape and for accommodating and supporting the body shaft and the body joint and training device mounting locations 1202 for accommodating and supporting the training devices.

Figure 19:
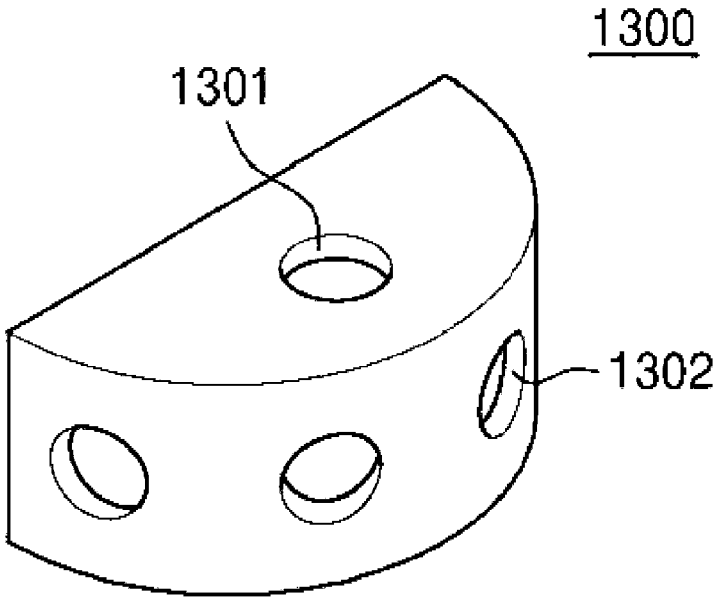
FIG. 19 is a perspective view illustrating one example of the body applicable to the modular training apparatus system according to the exemplary embodiment illustrated in FIGS. 15 and 16.

FIG. 19 is a perspective view illustrating one example of the body applicable to the modular training apparatus system according to the exemplary embodiment illustrated in FIGS. 15 and 16.

A body 1300 according to the exemplary embodiment shown in FIG. 19 includes mounting locations 1301 having a 3D shape with a semicircular cross section and for accommodating and supporting the body shaft and the body joint and training device mounting locations 1302 for accommodating and supporting the training devices.

Figure 20:
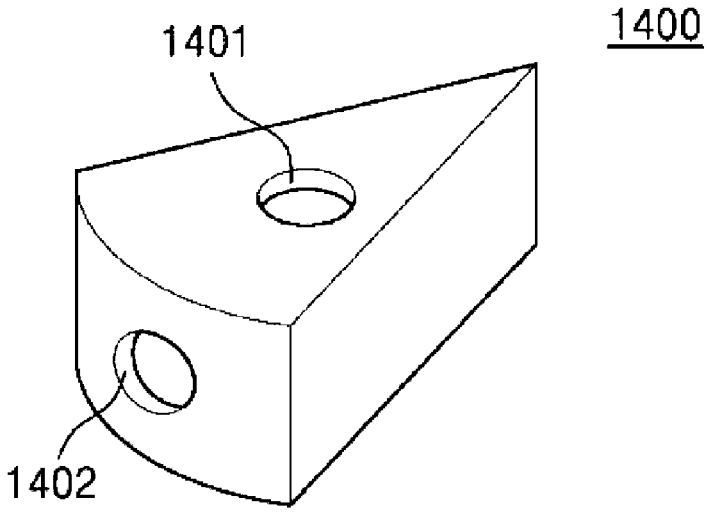
FIG. 20 is a perspective view illustrating one example of the body applicable to the modular training apparatus system according to the exemplary embodiment illustrated in FIGS. 15 and 16.

FIG. 20 is a perspective view illustrating one example of the body applicable to the modular training apparatus system according to the exemplary embodiment illustrated in FIGS. 15 and 16.

A body 1400 according to the exemplary embodiment illustrated in FIG. 20 includes mounting locations 1401 having a 3D shape with a substantially arc-shaped cross section and for accommodating and supporting the body shaft and the body joint and training device mounting locations 1402 for accommodating and supporting the training devices.

Figure 21:
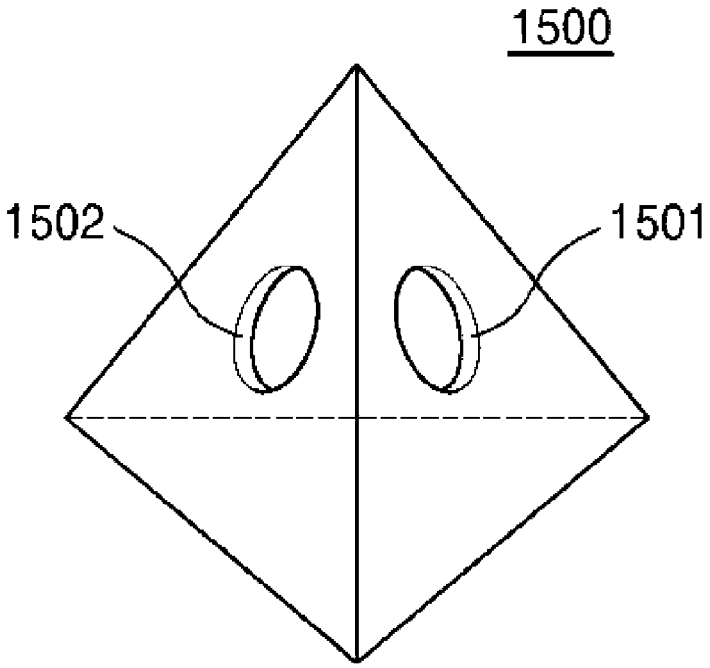
FIG. 21 is a perspective view illustrating one example of the body applicable to the modular training apparatus system according to the exemplary embodiment illustrated in FIGS. 15 and 16.

FIG. 21 is a perspective view illustrating one example of the body applicable to the modular training apparatus system according to the exemplary embodiment illustrated in FIGS. 15 and 16.

A body 1500 according to the exemplary embodiment illustrated in FIG. 21 includes mounting locations 1501 having a three-dimensional shape such as a pyramid shape and for accommodating and supporting the body shaft and the body joint and training device mounting locations 1502 for accommodating and supporting the training devices.

The mounting location of the body according to the exemplary embodiment illustrated in FIGS. 18 to 21 may be used for accommodating and supporting the training device and similarly, the training device mounting location may be used for accommodating and supporting the body shaft and the body joint.

By using the body having the configuration according to the exemplary embodiment illustrated in FIGS. 18 to 21, it is possible to manufacture a body-shaped training apparatus system by assembling bodies of various shapes.

A description of configurations and effects of the exemplary embodiments is just illustrative, and it would be appreciated by those skilled in the art that various modifications and other equivalent exemplary embodiments may be made therefrom. Accordingly, the true technical scope of the present invention should be defined by the appended claims.

<Description of symbols>

| | |
|---|---|
| 10: Shaft | 420: Joint |
| 11a: Coupling hole | 430: Joint support |
| 11b: Set screw | 431: Joint contact portion |
| 11: One end portion | 432: Rear mounting portion |
| 12a: Coupling hole | 440: Shaft support |
| 12b: Set screw | 441b: Mounting portion |
| 12d: Groove | 441: Second contact portion |
| 12: The other end portion | 441a: Elastic portion |
| 20: Joint | 442b: Mounting portion |
| 21: Coupling projection | 442: First contact portion |
| 21a: Fastening hole | 442a: Elastic portion |
| 30: Joint support | 470: Front case |
| 30a: Fastening hole | 471b: Fastening screw |
| 31: Joint contact portion | 480: Rear case |
| 32: Rear mounting portion | 510: Shaft |
| 40: Shaft support | 511: One end portion |
| 41: Second contact portion | 520: Joint |
| 41a: Elastic portion | 530: Joint support |
| 42: First contact portion | 531: Joint slider |
| 42a: Elastic portion | 532: Joint elastic support |
| 50: Impact absorbing portion | 540: Shaft support |
| 51: Hollow | 541: First contact portion |
| 60: Fist part | 542: Second contact portion |
| 61: Coupling projection | 570: Front case |
| 61a: Fastening hole | 571: Groove |
| 70: Front case | 580: Rear case |
| 71a: Through hole | 581: Groove |
| 71b: Fastening screw | 610: Shaft |

-continued

<Description of symbols>

| | |
|---|---|
| 71: Opening | 611: One end portion |
| 71d: Threaded surface | 620: Joint |
| 80: Rear case | 630: Joint support |
| 81d: Threaded surface | 631: Joint slider |
| 81a: Through hole | 632: Joint elastic support |
| 81b: Fastening screw | 640: Shaft support |
| 41b, 42b: Mounting portion | 641: First contact portion |
| 41c, 42c: Fastening hole | 642: Second contact portion |
| 41a, 42a: Elastic portion | 670: Front case |
| 85: Base | 671: Groove |
| 90: Wall body | 680: Rear case |
| 100: First training device | 681: Groove |
| 120d: Head connection training device | |
| 350, 360: Third and fourth training devices | |
| 120: Head | 710: Shaft |
| 121: Shaft | 711: One end portion |
| 130d: Base connection training device | 355, 365: Joint |
| 130: Main body | 720: Joint |
| 131: Shaft | 730: Joint support |
| 140: Base | 740: Shaft support |
| 150: Second training device | 741: Second contact portion |
| 200: Training device | 742: First contact portion |
| 210: Shaft | 760: Fist part |
| 250: Impact absorbing portion | 770: Case |
| 260: Fist part | 780: Rear case |
| 285: Base | 790: Wall body |
| 287: Band | 810: Shaft |
| 290: Main body | 820: Joint |
| 300: Modular sandbag | 830: Joint support |
| 310: First training device | 831a: Joint slider |
| 320: Second training device | 831b: Rear projection |
| 330: Third training device | 832: Joint elastic support |
| 340: Main body | 441b, 442b: Mounting portion |
| 345: Shaft | 441a, 442a: Elastic portion |
| 370: Head | 470, 480: Case |
| 375: Shaft | 541a, 542a: Shaft slider |
| 380: Fixing portion | 541b, 542b: Shaft elastic support |
| 390: Base | 641c, 642c: Shaft elastic support |
| 410: Shaft | 641a, 642a: Elastic portion |
| 411: One end portion | 641b, 642b: Shaft slider |

The invention claimed is:

1. A training device comprising:

a shaft;

a joint having a diameter larger than that of one end portion of the shaft and disposed at a first end of the one end portion of the shaft;

a joint support contacting the joint and elastically supporting the joint;

a shaft support elastically supporting an outer side of the shaft at the one end portion of the shaft; and a case surrounding the one end portion of the shaft, wherein when the shaft is pulled so that the joint is spaced apart from the joint support, the shaft support is widened and the joint passes through the shaft support and thereafter, the joint is supported by the shaft support, and wherein the joint support includes a plurality of support plates that are separate from each other, each of the support plates has a joint contact portion directly contacting the joint and a rear mounting portion that is extended from the joint contact portion and coupled to the case.

2. The training device of claim 1, wherein:

the joint has a cross section having a circular, oval, or a polygonal shape, the joint having a three-dimensional shape including including an outer surface which is convex or concave and the joint support has a joint contact portion having a concave or convex shape corresponding to a part of the outer surface of the joint and having elasticity.

3. The training device of claim 1, wherein:

the shaft support includes a first contact portion elastically supporting the outer side of the one end portion of the shaft and a second contact portion disposed spaced apart from the first contact portion toward an opposite side of the one end portion of the shaft to elastically support the outer side of the shaft, and the first contact portion and the second contact portion are arranged to form mirror image symmetry.

4. The training device of claim 3, wherein:

when the shaft and the joint are pulled in a direction away from the joint support, the first contact portion is widened and the joint thus moves between the first contact portion and the second contact portion, and the shaft is supported by the second contact portion.

5. The training device of claim 3, wherein the case supports the first and second contact portions.

6. The training device of claim 5, wherein:

the case includes a front case accommodating the first and second contact portions and a rear case accommodating the joint support.

7. The training device of claim 5, wherein:

each of the first and second contact portions includes a shaft slider slidably installed in the case to be movable toward the outer side of the shaft and a shaft elastic support elastically supporting the shaft slider with respect to the case.

8. The training device of claim 7, wherein:

each of the first and second contact portions further includes an elastic portion coupled to an end of the shaft slider to elastically contact the outer side of the shaft.

9. A training device comprising:

a shaft;

a joint having a diameter larger than that of one end portion of the shaft and disposed at a first end of the one end portion of the shaft;

a joint support contacting the joint and elastically supporting the joint; and a shaft support elastically supporting an outer side of the shaft at the one end portion of the shaft, wherein the shaft support includes a first contact portion elastically supporting the outer side of the one end portion of the shaft and a second contact portion disposed spaced apart from the first contact portion toward an opposite side of the one end portion of the shaft to elastically support the outer side of the shaft, wherein the training device further includes a case supporting the first and second contact portions and surrounding the one end portion of the shaft, wherein each of the first and second contact portions includes a mounting portion supported by the case and an elastic portion which extends toward the outer side of the shaft from the mounting portion to elastically support the outer side of the shaft, and wherein the joint support includes a plurality of support plates that are separate from each other, each of the support plates has a joint contact portion directly contacting the joint and a rear mounting portion that is extended from the joint contact portion and coupled to the case.

10. The training device of claim 9, wherein:

the elastic portions of the first and second contact portions face each other and extend toward the outer side of the shaft from the respective mounting portions.

* * * * *